US008857337B2

(12) United States Patent
Ngo

(10) Patent No.: US 8,857,337 B2
(45) Date of Patent: Oct. 14, 2014

(54) METHOD FOR PRINTING AN IMAGE ON THE UNDER PEAK OF A BASEBALL CAP AND BASEBALL CAP

(71) Applicant: Accolade Group Inc., Richmond Hill (CA)

(72) Inventor: Hyman Ngo, Toronto (CA)

(73) Assignee: Accolade Group Inc., Richmond Hill, Ontario (CA)

( * ) Notice: Subject to any disclaimer, the term of this patent is extended or adjusted under 35 U.S.C. 154(b) by 36 days.

(21) Appl. No.: 13/827,102

(22) Filed: Mar. 14, 2013

(65) Prior Publication Data

US 2014/0261037 A1 Sep. 18, 2014

(51) Int. Cl.

| | |
|---|---|
| ***B41F 23/00*** | (2006.01) |
| ***A42C 1/00*** | (2006.01) |
| ***B41M 5/382*** | (2006.01) |
| ***A42B 1/02*** | (2006.01) |

(52) U.S. Cl.
CPC . *B41M 5/382* (2013.01); *A42B 1/02* (2013.01)
USPC ..... 101/483; 101/487; 223/12; 223/26; 223/51

(58) Field of Classification Search
USPC ..... 101/483
See application file for complete search history.

(56) References Cited

U.S. PATENT DOCUMENTS

| | | | | |
|---|---|---|---|---|
| 1,792,152 | A | | 2/1931 | Ellis et al. |
| 1,870,516 | A | | 8/1932 | Kunz et al. |
| 1,874,177 | A | | 8/1932 | Ellis |
| 2,288,992 | A | | 7/1942 | Cassel |
| 2,424,857 | A | | 7/1947 | Scull |
| 2,825,707 | A | | 3/1958 | Auer |
| 2,918,345 | A | | 12/1959 | Caliezi |
| 3,103,404 | A | | 9/1963 | Salvin et al. |
| 4,021,591 | A | | 5/1977 | DeVries et al. |
| 4,245,992 | A | | 1/1981 | Yamashita et al. |
| 4,266,476 | A | * | 5/1981 | Maloof ..... 101/35 |
| 4,314,812 | A | | 2/1982 | Feess |
| 4,576,610 | A | | 3/1986 | Donenfeld |
| 5,162,135 | A | | 11/1992 | Gregory et al. |
| 5,218,908 | A | * | 6/1993 | Whitfield ..... 101/487 |
| 5,536,275 | A | | 7/1996 | Bohrer |
| 6,787,503 | B2 | | 9/2004 | Suh |
| 7,191,702 | B2 | * | 3/2007 | Kercher ..... 101/483 |
| 8,231,034 | B2 | * | 7/2012 | Styles et al. ..... 223/12 |
| 2010/0035029 | A1 | | 2/2010 | Ngo et al. |
| 2010/0103207 | A1 | | 4/2010 | Kushner et al. |
| 2010/0151182 | A1 | | 6/2010 | Canico |

FOREIGN PATENT DOCUMENTS

WO WO 2008/036620 A2 3/2008

* cited by examiner

*Primary Examiner* — Jill Culler
(74) *Attorney, Agent, or Firm* — Philip C. Mendes da Costa; Bereskin & Parr LLP/S.E.N.C.R.L., s.r.l.

(57) ABSTRACT

A method for printing on a lower surface of a peak of a baseball cap comprising: a) printing an image on the lower surface of the peak when the peak is at an elevated printing temperature and when the peak is in a generally planar configuration; b) allowing the peak to cool to a temperature below an elevated formation temperature; and, c) heating the peak to the elevated formation temperature and applying a non-planar shape to the peak, wherein the peak comprises a deformable insert that is solid at the elevated printing temperature and deformable at the elevated formation temperature.

18 Claims, 5 Drawing Sheets

METHOD FOR PRINTING AN IMAGE ON THE UNDER PEAK OF A BASEBALL CAP AND BASEBALL CAP

FIELD

The specification relates to a method for printing an image, which may be a high resolution image, on the under peak of a cap and, preferably, a baseball cap. The specification also relates to a baseball cap which has an image printed on the under peak.

INTRODUCTION

Various methods for applying an image to clothing, such as T-shirts are known. These include using an image transfer, silk screen printing and sublimation printing. Typically, these printing methods are designed to apply an image to a substrate, such as a T-shirt, that is flat.

Baseball caps typically are decorated, such as by a team logo provided on the front panel of the cap portion of the baseball cap. The image may be printed directly on a baseball cap such as by digital heat transfer printing, low resolution direct screen printing or the like. The image may also be applied by sewing a badge thereto or by printing on an applique, which may then be affixed (such as by an adhesive) to the baseball cap.

Sublimation printing is generally known in the art and comprises using heat sensitive dyes (also known as sublimation dyes) that are on a transfer substrate to print a desired image onto a receiving substrate, such as a T-shirt. The fabric surface to be printed and the transfer substrate are aligned and then heat pressed at a high temperature. The heat causes the solid dye contained on the transfer substrate to vaporize into a gas and transfer to the fabric. When the fabric cools below the vaporization temperature, the gas reverts to a solid state leaving the dye on the fabric. As a result, the image is transferred to the fabric.

SUMMARY

The following summary is provided to introduce the reader to the more detailed discussion to follow. The summary is not intended to limit or define the claims. One or more inventions may reside in any combination or sub-combination of the elements or process steps disclosed in any part of this document including its claims and figures.

According to one broad aspect of this disclosure, a method for printing an image, which may be a high quality image, on the under peak of a finished cap, such as a baseball cap, is provided. In accordance with this aspect, an image is provided to the under peak by subjecting a flattened under peak to sublimation printing. After the under peak has cooled and the image is set (e.g., the dye has converted back to a solid), the under peak is subjected to a reshaping process. During the reshaping process, the under peak is again heated and shaped to a desired shape, which may be the curved shape of the under peak prior to the printing process.

The peak of a baseball cap is typically provided with an insert that may be plastic. As such the peak will retain a shape if that shape is applied at an elevated temperature (a reshaping temperature) and the shape is maintained while the peak cools to a temperature at which the plastic insert will itself maintain a particular shape.

It has surprising been determined that the image printed on the under peak is not smudged or otherwise marred or blurred by the reshaping process. After the printing process, the peak of a baseball cap would be generally flat. Therefore, the insert must be raised to a formation temperature in order to reshape the peak. Despite the dye being volatile at elevated temperature, the quality of the image is not affected by the heating and manipulation of the under peak during the reshaping process.

In accordance with this aspect, there is provided a method for printing an image onto a lower surface of a peak of a baseball cap (the under peak) comprising the steps of:

a) printing an image on the lower surface of the peak when the peak is at an elevated printing temperature and when the peak is in a generally planar configuration;

b) allowing the peak to cool to a temperature below an elevated formation temperature; and, c) heating the peak to the elevated formation temperature and applying a non-planar shape to the peak, wherein the peak comprises a deformable insert that is solid at the elevated printing temperature and deformable at the elevated formation temperature.

In some embodiments, the printing may comprise sublimation printing.

In some embodiments, the elevated formation temperature may be lower than the elevated printing temperature.

In some embodiments, the image may be stable at the elevated formation temperature.

In some embodiments, the elevated printing temperature may be between about 375° F. to 475° F., and optionally 400° F. to 425° F.

In some embodiments, the elevated formation temperature may be between about 150° F. to 300° F., and optionally 250° F. to 275° F.

In some embodiments, the baseball cap may be cooled to room temperature following printing.

In some embodiments, the baseball cap may be air cooled following printing.

In some embodiments, the image may have a resolution of at least 300 DPI. Optionally, the image may have a resolution of equal to or greater than 300 DPI, equal to or greater than 360 dpi, equal to or greater than 600 DPI or equal to or greater than 720 DPI In some embodiments, the lower surface of the peak may comprise polyester or a polyester/cotton blend.

In some embodiments, the image may not be printed on any stitching.

In some embodiments, deformable insert may be plastic. Optionally, the deformable insert may be 2 or 3 mm polyvinyl chloride.

In some embodiments, the deformable insert may be cardboard.

In some embodiments, the baseball cap may be a finished, or fully assembled, baseball cap.

In some embodiments, step (c) may comprise applying the non-planar shape using a press.

In some embodiments, the peak may be curved prior to step (a) and step (c) may comprise reforming the peak into a curved configuration.

In another broad aspect of the disclosure, a baseball cap produced by the methods described above is provided. It will be appreciated that the baseball cap may be produced by any embodiment of the methods previously described.

One advantage of the method is that it provides an efficient and cost-effective method for printing durable, bright, high-resolution images (e.g., a resolution of at least 300 DPI and preferably at least 360 DPI) on the under peak of a finished baseball cap.

It will be appreciated by a person skilled in the art that a printing process may use any one or more of the features contained herein and that the features may be used in any particular combination or sub-combination.

DRAWINGS

The drawings included herewith are for illustrating various examples of articles, methods, and apparatuses of the teaching of the present specification and are not intended to limit the scope of what is taught in any way. In the drawings.

DESCRIPTION OF VARIOUS EMBODIMENTS

Various processes and compositions will be described below to provide an example of each claimed invention. No invention described below limits any claimed invention and any claimed invention may cover processes and compositions that are not described below. The claimed inventions are not limited to processes and compositions having all of the features of any one process or composition, or to features common to multiple or all of the processes or compositions described below. It is possible that a process or composition described below is not an embodiment of any claimed inventions.

In accordance with the present disclosure, a method is provided for printing an image on the under peak of a baseball cap. According to this embodiment, the process comprises printing an image on the lower surface of the peak when the peak is at an elevated printing temperature and when the peak is in a generally planar configuration; allowing the peak to cool to a temperature below an elevated formation temperature; and, heating the peak to an elevated formation temperature and applying a non-planar shape to the peak. In one embodiment, the peak comprises a deformable insert that is solid at the elevated printing temperature and deformable at the printing temperature and the formation temperature.

Figure 1:
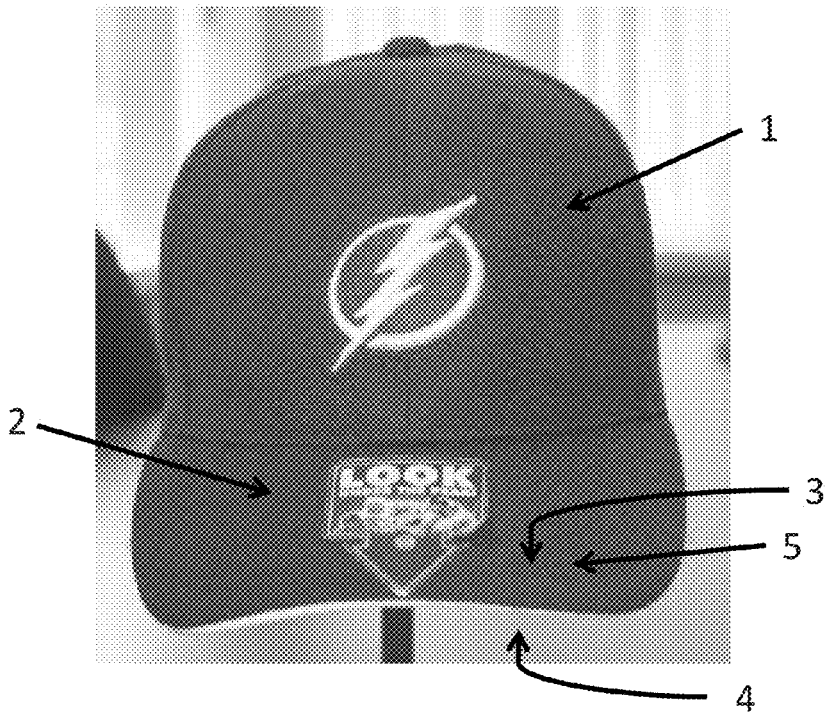
FIG. 1 shows a typical baseball cap comprising a peak.
Figure 2:
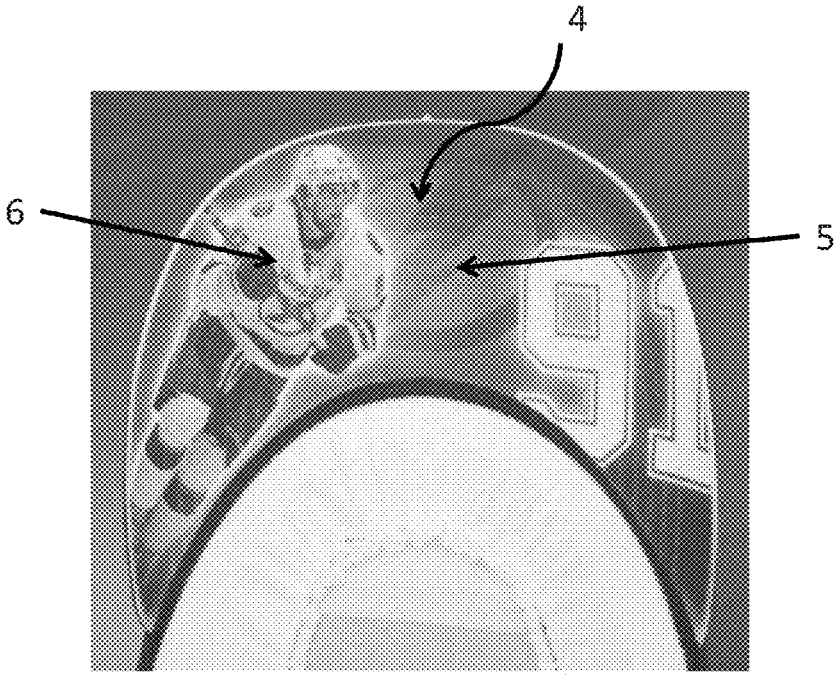
FIG. 2 depicts the under peak of a baseball cap with an image that has been printed according to one embodiment of the methods described herein.

Baseball caps are well known in the art. As shown in FIG. 1, baseball caps typically comprise a cap portion 1 that covers the top of the head. Attached to cap portion 1 is a peak 2. The peak 2 may be also referred to as a brim or a visor. Cap potion 1 may be of any design and peak 2 may be affixed thereto by any means known in the art. In some embodiments, the cap portion may comprise a head band such that the cap is essentially a visor. The peak 2 comprises an upper surface 3 and a lower surface 4. The lower surface 4 is also referred to as an "under peak". The lower surface 4 comprises a fabric such as polyester or a polyester blend. As shown in FIG. 2, printed on lower surface 4 is image 6. The non-planar, or curved configuration of the peak is provided by an insert 10, such as that shown in FIGS. 3 and 4, which is situated between upper surface 3 and lower surface 4.

Figure 3:
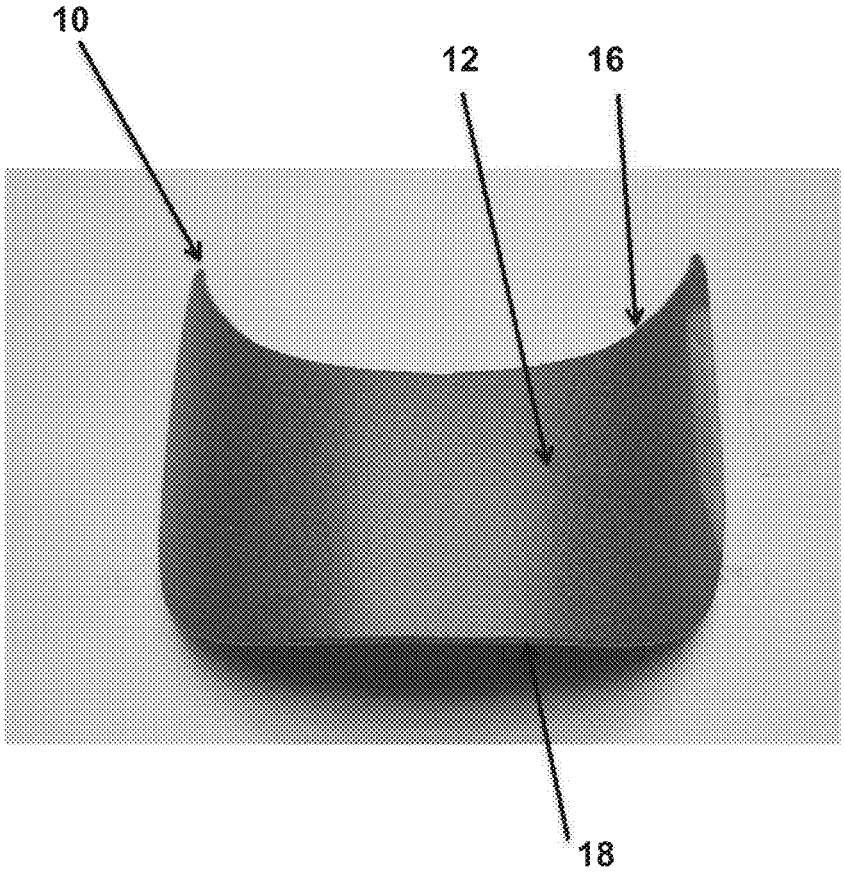
FIG. 3 is a top perspective view of an insert for the peal of a baseball cap.
Figure 4:
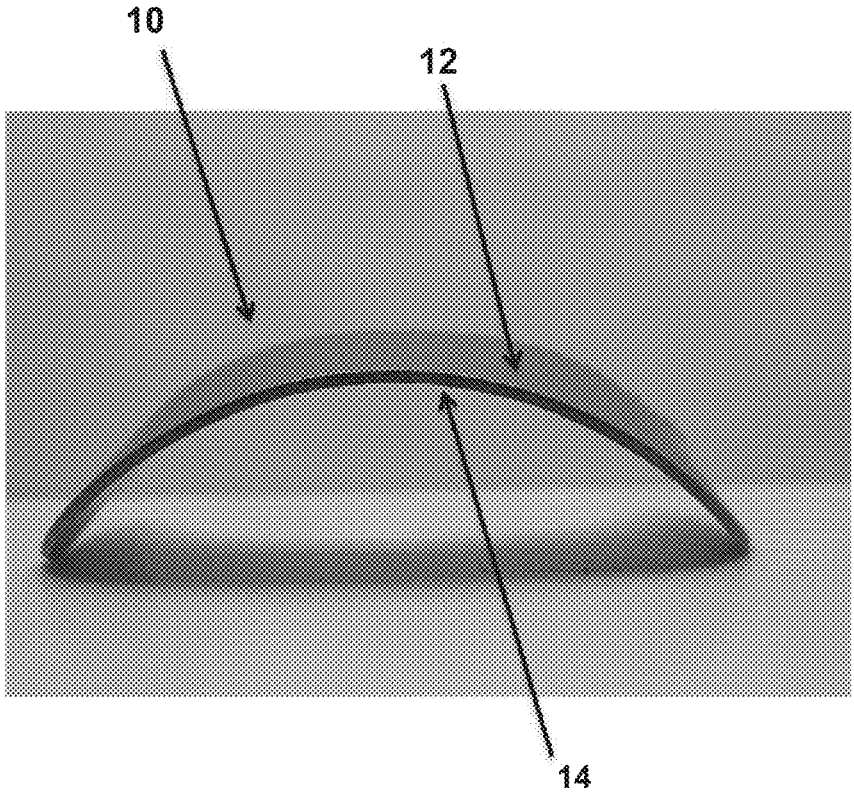
FIG. 4 is a top side view of the insert of FIG. 3.

As shown in FIGS. 3 and 4, insert 10 has an upper surface 12, a lower surface 14, a rear edge 16 and a front edge 18. Insert 10 may be of any size and is preferably sized to define all, or essentially all, of the peak 2. The insert 10 may be of any configuration and is secured to the cap portion 1 by any means. Preferably, insert 2 is sandwiched between the fabric that comprises upper surface 3 and the fabric that comprises lower surface 4.

The insert comprises may be made from any material that has the following properties: it maintains the non-planar or curved shape of the peak during normal use, it is solid (for example, does not melt or degrade) at an elevated printing temperature, and it is deformable at an elevated formation temperature. As used herein, the term "deformable" means that the shape of the insert can be manipulated, for example, the insert can be formed into the non-planar shape or curved configuration typical of the peak of a baseball cap. As described in greater detail below, the elevated printing temperature is optionally from about 375 to about 475° F., and is preferably from about 400° F. to about 425° F. The elevated formation temperature is optionally from about 150° F. to 300° F., and is preferably from about 250° F. to about 275° F. In one embodiment, the insert is cardboard. In another embodiment, the insert is plastic, such as polyvinyl chloride (PVC), but may be another thermformable plastic. A PVC insert may be, for example, 2 to 3 mm thick.

Insert 2 may be secured between upper and lower surfaces 3 and 4 by any means and may be secured therebetween by stitching 5 that passes through the insert 10 between upper and lower surfaces 3 and 4.

Figure 5:
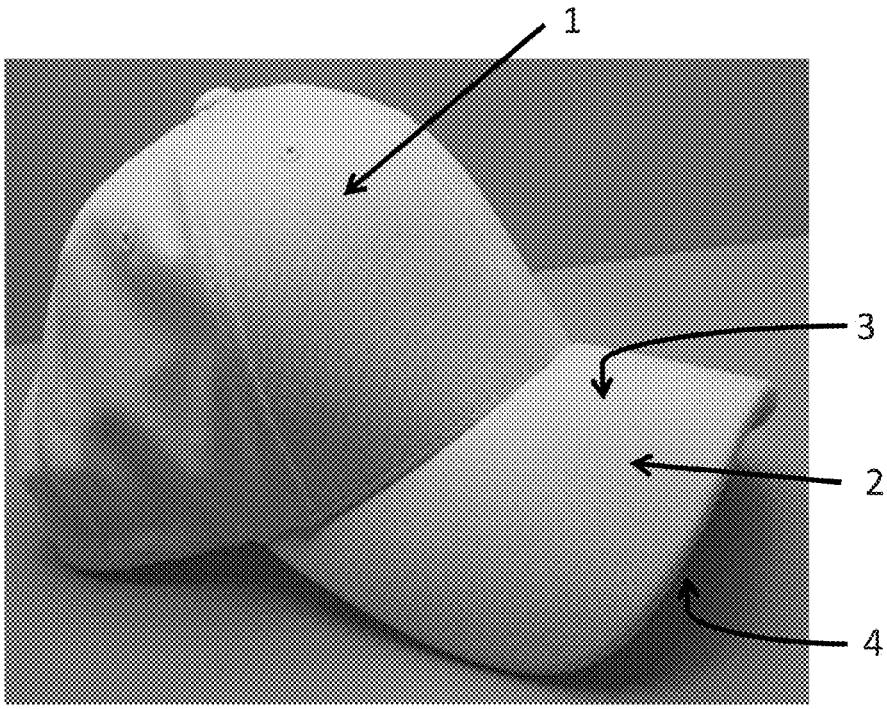
FIG. 5 is a side view of a baseball cap comprising a peak with no stitching.

As it may be difficult to print on stitching, the lower surface of the peak, or the portion of the lower surface on which the image is to be printed, optionally comprises no stitching or only a minimum amount of stitching. In some embodiments, such as the embodiment shown in FIG. 5, the peak 2 may contain no stitching. In other embodiments, stitching may be provided on only the periphery of peak 2 so as to leave a central area that has an absence of stitching. Alternately, the stitching may be provided at other locations so as to leave a central area that has an absence of, or a reduced amount of, stitching. The stitching provides a visual distraction of the image on the under peak and therefore detracts from the image printed thereon. Accordingly the stitching may be positioned so as to interfere less with the image.

As exemplified, the lower surface 4 of the peak 1 comprises a fabric surface. The fabric may be made from a natural fiber, a synthetic fiber or a blend thereof. The fabric may be made from one or more natural fibers and may optionally be combined with one or more synthetic fibers. The natural fabric may be cotton, wool, hemp, silk and linen or a blend thereof. The synthetic fiber may be polyester, nylon, lycra, spandex and blends thereof and preferably comprises polyester. An exemplary fabric may be polyester or a polyester blend such as a blend of polyester and cotton. In one particular embodiment, the polyester blend comprises at least about 50%, preferably at least about 75% and more preferably at least about 95% polyester. In another embodiment, the polyester blend is a blend of polyester and cotton, optionally a blend of about 50% cotton and about 50% polyester or a blend of cotton and at least about 50% polyester. Other polyester blends include blends of about 60% cotton/40% polyester, about 35% cotton/65% polyester and about 40% cotton/60% polyester.

According to one embodiment of the disclosure, an image is printed on the lower surface of the peak of a finished or fully assembled, baseball cap. While the peak of a baseball cap is normally in a curved configuration, the peak may be in a generally planar, or generally flat, configuration during the printing process. A flat peak allows an image to be accurately printed on the lower surface. The peak may be flattened before the image is transferred to the lower surface or the peak or during the printing process. Preferably, the peak is flattened during the printing process. For example, the peak may be subjected to a preliminary heat treatment step to flatten the peak and then transferred to a printing station. In such a process, the peak may be maintained at an elevated temperature as the peak is transferred to the printing station. Alternately, the preliminary heat treatment step may occur at one time and the peak allowed to cool. Accordingly, a stock of baseball caps with a flattened peak may be prepared for subsequent printing. Alternately, the peak may be flattened concurrently with the printing step. For example, the peak may be placed in a printing machine (e.g. a sublimation printer). The peak may then be heated and flattened in the sublimation printer. Accordingly, the peak may be flattened at the same time as the under peak is printed.

The image may be printed on the lower surface of the peak using any known process. Preferably, the image is printed using heat. A preferred process is sublimation printing. Any sublimation printing process known in the art may be sued. For example, an image may be printed onto a transfer substrate and then the image may be transferred on to the fabric through the use of heat. The transfer for use in the printing process may be of any design and the transfer substrate may be any used in the printing industry.

In one aspect of the disclosure, sublimation printing comprises:

(a) printing an image onto a transfer substrate using sublimation inks; and, (b) positioning the transfer substrate on the lower surface of the peak and applying heat and pressure to transfer the sublimation inks to the fabric.

According to one embodiment, an image, preferably a high-resolution image (e.g., equal to or greater than about 300 DPI, equal to or greater than 300 360 dpi, equal to or greater than 300 600 DPI or equal to or greater than 300 720 DPI, i.e., dots per inch) is prepared using, e.g., an appropriately programmed computer. An exemplary program that may be used is Adobe Illustrator. The reverse image of the final design may then be digitally printed using sublimation inks onto the transfer substrate. Appropriate printers, inks and transfer substrates are known in the art and are available from various suppliers. For example, the transfer substrate may be paper, cardboard, cloth, foil, plastic, film or any other material that can carry ink. In one embodiment of the disclosure, the transfer substrate is transfer paper.

In accordance with sublimation printing, the image may be transferred to the fabric using a combination of heat and pressure. Preferably, the image is transferred at an elevated printing temperature of, e.g., from about 375° F. to about 475° F. and preferably from about 400° F. to about 425° F. The fabric and transfer substrate are pressed together with an applied pressure of, e.g., at least about 60 pounds per inch, and preferably at least about 100 to 120 pounds per inch. The heat and pressure may be applied for about 25 to 60 seconds and, preferably, about 30 to 45 seconds. In one embodiment, the pressure used in the sublimation printing process also acts to flatten the peak.

The image is optionally a high-definition image and it may be a photograph or a digitally created image. The image may be a black and white image, grey-scale image or, preferably, a color image. Preferably, the high-resolution image is an image with a DPI value equal to or greater than about 300 DPI, equal to or greater than about 360 DPI, equal to or greater than about 600 DPI or equal to or greater than about 720 DPI.

A base coat is optionally applied to the fabric prior to sublimation printing. In one embodiment, the base coat is applied to fabrics with a polyester content of less than about 50%. The base coat composition optionally includes an organosilicon compound such as polydimethylsiloxane. In one aspect of the disclosure, the base coat is applied as a liquid base coat mixture and the fabric is dried prior to printing.

Following the transfer of the image to the lower surface of the peak, the peak is allowed to cool. In one embodiment, the peak is cooled to room temperature, optionally from about 60° F. to about 80° F. or about 70° F. The peak may be cooled by allowing it to sit at room temperature (also known as air cooling) or it may be actively cooled by refrigeration or any other cooling means known in the art.

Once the peak has been cooled, it is heated to an elevated formation temperature and a non-planar shape is applied to the peak. In one embodiment, this step includes reforming the peak into the curved configuration typical of a baseball cap. Any means known in the art may be used to apply the non-planar shape. In one embodiment, the non-planar shape is applied using a press. Any heating means known in the art may be used to heat the peak to the elevated formation temperature. The peak may be heated before being transferred to a reforming station, which is used to provide a desired shape to a peak. Alternately, the peak may be heated at the reforming station so that the same machinery may be used to heat and reshape the peak. For example, the peak may be placed in a press and heated while pressure is applied to form the desired shape for the peak.

The elevated reformation temperature may be any temperature that allows the peak to be reformed in to the non-planar or shape typical of the peak of a baseball cap. Optionally, the elevated reformation temperature is from about 150° F. to about 300° F., and is preferably from about 250° F. to about 275° F. The reformation temperature is below the temperature at which the insert melts and is preferably below the printing temperature.

It has been determined that the image printed on the under peak is stable at the elevated formation temperature. For example, the image is not melted or degraded at the elevated formation temperature. In one embodiment, the image is at the same resolution before and after the peak is heated to the elevated formation temperature.

EXAMPLES

Example 1

Printing a High Resolution Image on the Under Peak of a Baseball Cap

The lower surface of the peak of a baseball cap shown in FIG. 2 was printed according to the following process.

1. A graphic image was designed and digitally printed onto sublimation transfer paper.
2. A baseball cap was loaded onto a station for sublimation printing.
3. The transfer paper was aligned on the lower surface of the peak and heat and pressure was applied to the lower surface at 400 to 425° F. for 30 to 45 seconds to (a) flatten the peak and (b) transfer the image to the lower surface.
4. The transfer paper was peeled off the lower surface to expose the transferred image.
5. The baseball cap was allowed to cool to room temperature.
6. The baseball cap was heated to 250 to 275° F.
7. Using a press, the peak was reformed into a curved configuration.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A method of printing on a lower surface of a peak of a cap comprising:

a) printing an image on the lower surface of the peak when the peak is at an elevated printing temperature and when the peak is in a generally planar configuration;

b) allowing the peak to cool to a temperature below an elevated formation temperature; and, c) heating the peak to the elevated formation temperature and applying a non-planar shape to the peak, wherein the peak comprises a deformable insert that is solid at the elevated printing temperature and deformable at the elevated formation temperature.

2. The method of claim 1, wherein the printing comprises sublimation printing.

3. The method of claim 1, wherein the elevated formation temperature is lower than the elevated printing temperature.

4. The method of claim 1, wherein the image is stable at the elevated formation temperature.

5. The method of claim 1, wherein the elevated printing temperature is between about 375° F. to 475° F.

6. The method of claim 1, wherein the elevated formation temperature is between about 150° F. to 300° F.

7. The method of claim 1, where the cap is cooled to room temperature following printing.

8. The method of claim 1, wherein the cap is air cooled following printing.

9. The method of claim 1, wherein the image has a resolution of at least 300 DPI.

10. The method of claim 1, wherein the lower surface of the peak comprises polyester or a polyester/cotton blend.

11. The method of claim 1, wherein the image is not printed on any stitching.

12. The method of claim 1, wherein the deformable insert is plastic.

13. The method of claim 1, wherein the deformable insert comprises 2 or 3 mm polyvinyl chloride.

14. The method of claim 1, wherein the deformable insert comprises polyvinyl chloride.

15. The method of claim 1, wherein the deformable insert comprises cardboard.

16. The method of claim 1, wherein the cap is a finished baseball cap.

17. The method of claim 1, wherein step (c) comprises applying the non-planar shape using a press.

18. The method of claim 1, wherein the peak is curved prior to step (a) and step (c) comprises reforming the peak into a curved configuration.

* * * * *